United States Patent [19]

Yoshimoto et al.

[11] Patent Number: 5,024,545

[45] Date of Patent: Jun. 18, 1991

[54] MULTI-IMPACT CHARACTER ERASING APPARATUS WITH CONTROL OF CORRECTION RIBBON FEED

[75] Inventors: Satoshi Yoshimoto, Komaki; Masaya Funamoto, Nagoya, both of Japan

[73] Assignee: Brother Kogyo Kabushiki Kaisha, Japan

[21] Appl. No.: 442,307

[22] Filed: Nov. 28, 1989

Related U.S. Application Data

[63] Continuation of Ser. No. 173,544, Mar. 25, 1988, abandoned.

[30] Foreign Application Priority Data

Mar. 28, 1987 [JP] Japan ..... 62-75200

[51] Int. Cl.[5] ..... B41J 29/373

[52] U.S. Cl. ..... 400/696; 400/232; 400/210

[58] Field of Search ..... 400/210, 229, 232, 233, 400/320, 303, 695, 697, 697.1, 696

[56] References Cited

U.S. PATENT DOCUMENTS

| | | | |
|---|---|---|---|
| 3,326,346 | 6/1967 | Sasahi | 400/157.1 X |
| 3,397,766 | 8/1968 | Spalinger et al. | 400/157.1 X |
| 4,134,337 | 1/1979 | Arzoumanian | 101/93.48 X |
| 4,307,971 | 12/1981 | Kane, III et al. | 400/697 |
| 4,388,005 | 6/1983 | Wehking et al. | 400/144.2 |
| 4,472,073 | 9/1984 | Valle et al. | 400/216 |
| 4,613,249 | 9/1986 | Iwase et al. | 400/240.1 X |
| 4,637,144 | 1/1987 | Valle et al. | 400/216 X |
| 4,683,820 | 8/1987 | McGouty et al. | 400/157.1 X |
| 4,686,900 | 8/1987 | Crystal et al. | 101/93.48 X |
| 4,708,505 | 11/1987 | Tsumura et al. | 400/697.1 |

FOREIGN PATENT DOCUMENTS

| | | | |
|---|---|---|---|
| 3512575 | 10/1986 | Fed. Rep. of Germany | 400/697.1 |
| 142883 | 8/1983 | Japan | 400/697.1 |
| 160182 | 9/1983 | Japan | 400/697 |
| 158280 | 9/1984 | Japan | 400/697 |
| 60-147376 | 8/1985 | Japan | 400/697 |
| 198283 | 10/1985 | Japan | 400/697 |
| 253577 | 12/1985 | Japan | 400/144.2 |
| 241172 | 10/1986 | Japan | 400/157.1 |
| 244580 | 10/1986 | Japan | 400/144.2 |

*Primary Examiner*—David A. Wiecking

*Attorney, Agent, or Firm*—Evenson, Wands, Edwards, Lenahan & McKeown

[57] ABSTRACT

In a printed character printed with a printing apparatus provided with a plurality of type elements and a print hammer, the specified left or right edge portion thereof has ink adhered heavily on the paper, and this specified edge portion is difficult to be erased when erasing a wrongly printed character with a correction ribbon.

In the disclosed character erasable printing apparatus, after moving the carriage from the print position by a predetermined minute distance in the printing direction or in its opposite direction toward the specified edge portion, a first hammering for erasure is carried out, and subsequently after moving the carriage in the direction opposite to above-described movement, at least, and without feeding the correction ribbon relative to the carriage, a second hammering for erasure is carried out with an unused fresh portion of the correction ribbon made to face the specified edge portion having residual ink.

8 Claims, 8 Drawing Sheets

MULTI-IMPACT CHARACTER ERASING APPARATUS WITH CONTROL OF CORRECTION RIBBON FEED

This is a continuation of Ser. No. 07/173,544, filed Mar. 25, 1988, now abandoned.

BACKGROUND OF THE INVENTION

The present invention relates to a printing apparatus including an erasing mechanism for erasing printed characters and symbols, and specifically relates to a character erasable printing apparatus capable of surely erasing ink adhering heavily on the right-side or left-side edge part of a printed character.

Generally, character erasable printing apparatuses such as the typewriter comprises a printing apparatus for printing characters and symbols by hammering desired types on a type-wheel by a print hammer and an erasing mechanism capable of erasing characters and symbols printed by the printing mechanism.

For erasing characters and symbols by the erasing mechanism, the erasing mechanism adopts the cover lap method which corrects by adhering correcting agent onto the printed character or the lift-off method which corrects by lifting off ink on the printed character, and in recent years the lift-off system has been generally employed. In the lift-off method, a printed character or symbol to be erased is erased by hammering by a print hammer driven mechanically or by a solenoid through an erase ribbon.

Conventionally, for example, an erasing apparatus for impact printer is described in U.S. Pat. No. 4,307,971.

In this erasing apparatus, assuming errors of the stop positions of a print head at the print position and the erase position, first, the print head is moved from the print position in the direction of escapement by an amount of movement within a range of 2–20% of the amount of character escapement, then a first erasing operation being performed, and subsequently, the print head is moved from the print position in the direction reverse to that of escapement by an amount of movement within a range of 2–20% of the amount of character escapement, then a second erasing operation is performed.

In the printing apparatus describe in U.S. Pat. No. 4,388,005, by means of utilizing minute play ΔS caused by errors in stop position of a stepping motor for driving the carriage and backlash in the driving gear mechanism and wire tension, when the carriage is moved in the first direction and then the carriage is moved in the direction opposite to the first direction, the carriage can be stopped at different two positions displaced by an amount of 2ΔS relatively, where printing of bold face character and/or erasing of printed character can be carried out effectively.

In the printing apparatus described in U.S. Pat. No. 4,708,505, in order to avoid ink transfer from the correction ribbon to the paper in erasing a printed character at two or more impressions, a prescribed length of correction ribbon is fed after at least one erasing impession. Thus second erasing and third erasing can be conducted with fresh correction ribbon.

In an erasing apparatus described in the Japanese Patent provisional publication No. 147376/1985, for example, as shown in FIG. 9(*a*), first, a first erasing operation is performed at the position agreeing with the print position of a printed character '1', and subsequently, as shown in FIG. 9(*b*), a print head is moved in the direction of spacing by a predetermined minute distance b, and then a second erasing operation is performed, and further as shown in FIG. 9(*c*), the print head is moved from the print position in the direction of backspacing by the predetermined minute distance b, and then a third or a third and a fourth erasing operation is performed.

In addition, numeral 29 designates a correction ribbon, numeral 34 designates ink of the printed character, numeral 34*a* designates ink lifted off from the printed character, and symbol P designates print paper In the mechanical print hammer, to facilitate transfer of ink of a print ribbon onto print paper, as shown in FIG. 4 included in an embodiment of the present invention, on a head 7*b* of a print hammer, a large hammer weight 33 is mounted on the left side thereof, and a small hammer weight 32 is mounted on the right side thereof respectively, and when a type 5 is hammered by the print hammer, a turning torque is applied to the print hammer in the direction as shown by an arrow C along with a hammering force, and the type 5 sideslips in the direction as shown by an arrow D by a minute distance. As a result, as shown in FIG. 5, ink adheres to the right-side edge part of the character 'I' in a particularly firm manner, and this edge part becomes a portion where ink is difficult to be erased.

However, in the conventional erasing apparatus as described in FIG. 9, the first erase position is made to agree with the print position (refer to FIG. 9(*a*)), and therefore the ink 34*a* having a width equal to that of the printed character adheres to the correction ribbon 29 (refer to FIG. 9(*b*)), and the second erasure is executed in this state, and therefore the ink 34*a* has already adhered to the portion of the correction ribbon 29 corresponding to the right-side edge part, and even when the third erasure is executed thereafter as shown in FIG. 9(*c*), the ink 34 is left without being stripped off certainly as shown in FIG. 9(*d*), thereby raising a problem.

Furthermore, in the erasing apparatus as described in the above-described Japanese Patent Publication No. 6992/1981, the edge part of the character to be erased whereto ink adheres heavily is not taken into account, and therefore a problem exists that ink of the edge part remains.

SUMMARY OF THE INVENTION

The principal object of the present invention is to provide a character erasable printing apparatus wherein, in erasing a printed character or symbol having a left or right edge portion imprinted heavily with ink, an unused fresh correction ribbon is made to correspond to the edge portion difficult to be erased both at a first and a second erasing so as to be able to certainly strip off ink.

A character erasable printing apparatus according to the present invention comprises; inputting means for inputting data; printing means having a plurality of type elements of characters and symbols, a print ribbon, a hammering mechanism and a carriage capable of moving along a printing line; erasing means for erasing a printed character or symbol by hammering the same type element plural times onto the printed character or symbol through a correction ribbon in response to an operation of a correction command key; and correction controlling means which, in erasing operation of the erasing means, controls the carriage to move to a first erasing position displaced by a predetermined minute distance from the print position of the printed character or symbol in a first direction along the print line toward an edge portion difficult to be erased of the printed character or symbol and then controls the erasing means to conduct a first erasing, and subsequently controls the carriage to move to a second erasing position in a second direction opposite to the first direction until a fresh portion of the correction ribbon facing the type element faces the edge portion difficult to be erased and then controls the erasing means to conduct a second erasing.

In the character erasable printing apparatus above-described, the edge portion difficult to be erased of the printed character or symbol can be erased completely by erasing at least two times with unused fresh portion of the correction ribbon. Before the first erasing, the carriage is moved by only a predetermined minute distance, whereby the consumptive quantity of the correction ribbon can be saved effectively.

BRIEF DESCRIPTION OF THE DRAWINGS

FIG. 1 is a vertical-cross-sectional side view of the major part of a typewriter, FIG. 2 is an exploded perspective view of a clutching mechanism, FIG. 3 is a fragmental view equivalent to FIG. 2 when an operating lever rotates to the hammering position and prints a character, FIG. 4 is a plan view of the major part of the typewriter, FIG. 5 is a view explaining the state of adhesion of ink of a print ribbon at character printing by a printing mechanism, FIG. 6 is a block diagram of a control system of the typewriter, FIG. 7 is a flow chart of a routine of character correction control, FIG. 8 is a view explaining the character correction control.

DESCRIPTION OF THE PREFERRED EMBODIMENT

Hereinafter, description is made on an embodiment wherein the present invention is applied to a typewriter mechanically driving a print hammer with reference to the drawings.

Figure 1:
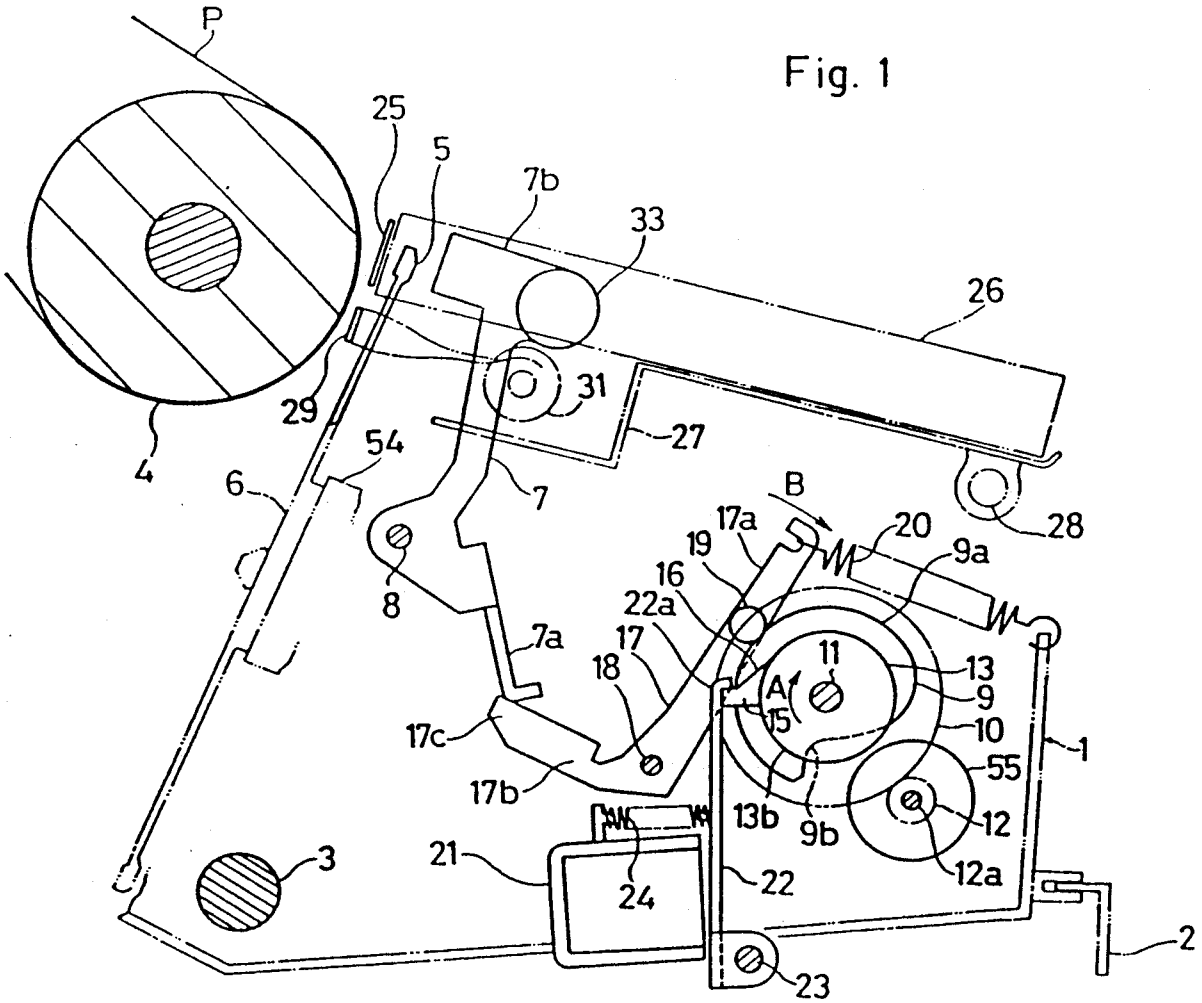
FIG. 1 through FIG. 8 show an embodiment in accordance with the present invention.

As shown in FIG. 1, in a frame (not illustrated), a carriage 1 is supported by a guide bar 2 and a guide shaft 3 and is disposed so as to be movable right and left along a platen 4. A type-wheel 6 having a number of types 5 on the outer periphery thereof is supported rotatably on the carriage 1, and a predetermined type 5 is disposed selectively at the print position facing print paper P on the platen 4 by rotation of a type-wheel drive motor 54.

Figure 2:
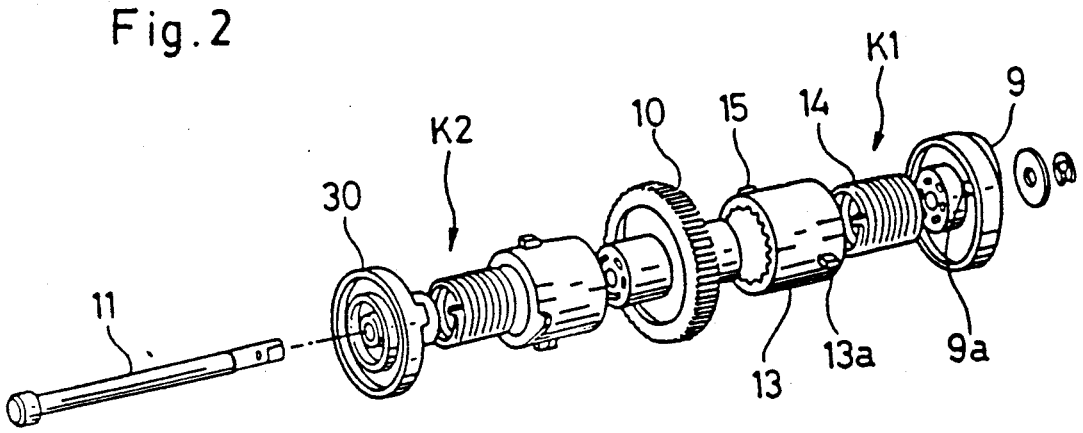

On the carriage 1, a print hammer 7 is disposed close to the type-wheel 6, and the print hammer 7 is supported by a shaft 8 in a manner capable of swinging, and is disposed at the retreat position apart from the platen 4 as shown in FIG. 1 except for the case of printing operation, and is moved to the print position where the type 5 is hammered onto the platen 4 in printing operation. The print hammer 7 is energized all the time to the retreat position by a spring. On the carriage 1, a hammer drive cam 9 (hereafter referred to as cam) is installed, and a driven gear 10 is rotated through a driving gear 12 on a drive shaft **12*a* driven by a DC motor 55 as described later. As shown in FIG. 2, a clutching mechanism K1 consisting of an engaging rotor 13 and a clutch spring 14 disposed in the engaging rotor 13 is installed between the cam 9 and the driven gear 10 which are journaled on a support shaft 11. The end part of the engaging rotor 13 is fitted rotatably into the cam 9, and an engaging claw 9*a* of the cam 9 is brought in contact with the upper surface of an engaging claw 13*a* of the engaging rotor 13, and one end of the clutch spring 14 is fixed to the cam 9, and the other end thereof is fixed to the driven gear 10**.

An engaging protrusion 15 is installed in a protruding manner on the outer peripheral surface of the engaging rotor 13, and a slant guide surface 16 slanting from the outer peripheral surface toward the intermediate part of the engaging protrusion 15 is formed on the tangent line of the outer peripheral surface. When rotation of the engaging rotor 13 is restrained through the engaging protrusion 15, rotation of the cam 9 is restrained by engagement of the engaging claw **13*a* with the engaging claw 9*a*, and the clutch spring 14 is deformed elastically. Also, when the restraint of rotation of the engaging rotor 13 is released, rotation of the driven gear 10 is transmitted to the cam 9, and the cam 9 is rotated in the direction as shown by an arrow A in FIG. 1**.

As shown in FIG. 1, between the print hammer 7 and the cam 9, a nearly L-shaped operating lever 17 as an operating member is supported rotatably by a shaft 18 at the intermediate part thereof on the carriage 1, and a cam follower 19 engaging with the cam 9 is installed in a protruding manner on a first arm **17*a* thereof, and an engaging part 17*c* engaging with a linking part 7*a* of the print hammer 7 from under is installed on a second arm 17*b*. The operating lever 17 is energized all the time by a tension spring 20 in the direction that the cam follower 19 engages with the cam 9**.

When the cam follower 19 is in contact with the equiradius part **9*a* of the cam 9, the operating lever 17 is located at the ready-to-operate position as show in FIG. 1, and the print hammer 7 is located at the retreat position through engagement with the linking part 7*a*. Attending on the rotation of the cam 9 in the direction as shown by the arrow A, the cam follower 19 engages with a recession 9*b* of the cam 9, and when the operating lever 19 is located at the hammering position (refer to FIG. 3), the operating lever 17 is allowed to rotate in the direction shown by an arrow B by the energized tension spring 20**.

Under the operating lever 17, a print hammer solenoid 21 is disposed on the carriage 1, and in front of the solenoid 21, an armature 22 disposed nearly in the vertical direction is supported by a shaft 23 rotatably relative to the frame, and the armature 22 is energized in the direction parting from the solenoid 21 by a compression spring 24 inserted between the solenoid 21 and the armature 22.

When energizing of the print hammer solenoid 21 is stopped, the armature 22 is located at either of a first operating position (refer to FIG. 1) where a tip part **22*a* of the armature 22 engages with the engaging protrusion 15 and a second operating position (refer to FIG. 3) where the tip part 22*a* of the armature 22 engages with the outer peripheral surface 13*b* of the engaging rotor 13, and in the state that it is located at the first operating position, rotation of the engaging rotor 13 is restrained. When the print hammer solenoid 21 is energized for a minute time, engagement of the tip part 22***a* of the armature 22 with the engaging protrusion 15 is released, and in the state that it is located at the second operating position, the restraint of rotation of the engaging rotor 13 and the cam 9 is released over a predetermined angular range, and the operating lever 17 is rotated from the ready-to-operate position to the hammering position.

Figure 6:
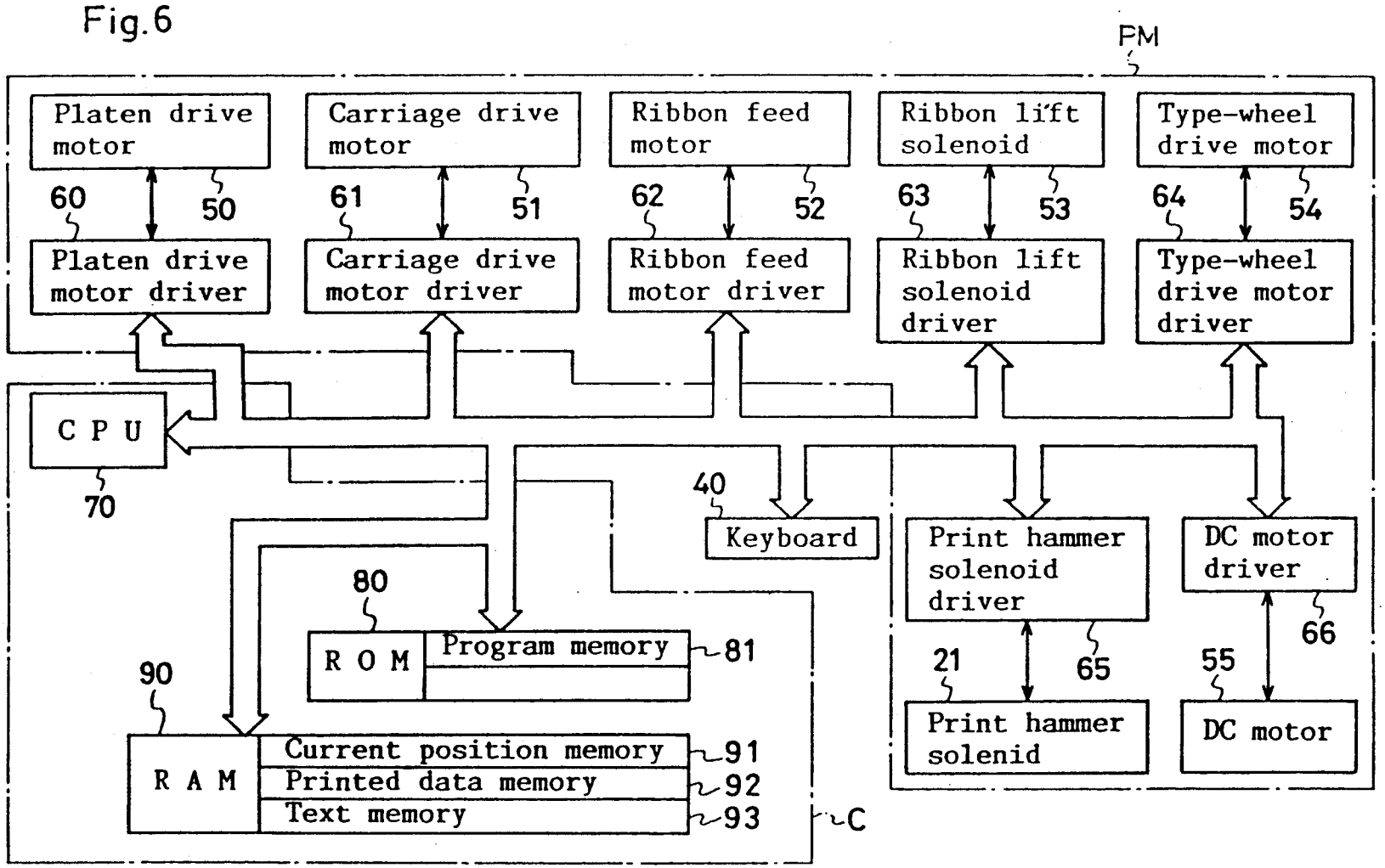

A ribbon cassette 26 storing a print ribbon 25 is mounted on a holder 27, and the front end part of the holder 27 is mounted in a manner capable of rotating relative to the carriage 1 by a shaft 28, and the print ribbon 25 is fed from a feed spool of the ribbon cassette 26, and is taken up on a take-up spool, and the take-up spool is driven by a ribbon feed motor 52 (refer to FIG. 6). A correction ribbon 29 for erasing printed characters and symbols is installed at the portion formed one-step lower in the rear part of the holder 27. A feed spool 31 for feeding the correction ribbon 29 is installed on the left side of the ribbon cassette 26, and a take-up spool for taking up the correction ribbon 29 is installed on the right side thereof.

Furthermore, in order to change over positions to the print position (FIG. 1) where the print ribbon 25 is located between the type 5 and the platen 4, to the pause position (not illustrated) where the print ribbon 25 is moved downward from the print position, and to the correcting position (not illustrated) where the correction ribbon 29 is located between the type 5 and the platen 4, a cam mechanism comprising a cam 30 for swinging the holder 27 to the three positions selectively is mounted on the carriage 1. This cam mechanism is transmitted a driving force of the DC motor 55 through a clutching mechanism K2 having a configuration similar to the clutching mechanism K1, and the clutching mechanism K2 is controlled based on operation of a ribbon lift solenoid 53 (refer to FIG. 6). Accordingly, the holder 27 is swung to the three positions by operation of the ribbon lift solenoid 53.

Furthermore, in the carriage 1 and the holder 27, a well-known correction ribbon taking-up mechanism (not illustrated) is installed which is for taking up the correction ribbon 29 on the take-up spool from the feed spool 31 attending on the swing of the holder 27 to the correcting position.

Figure 4:
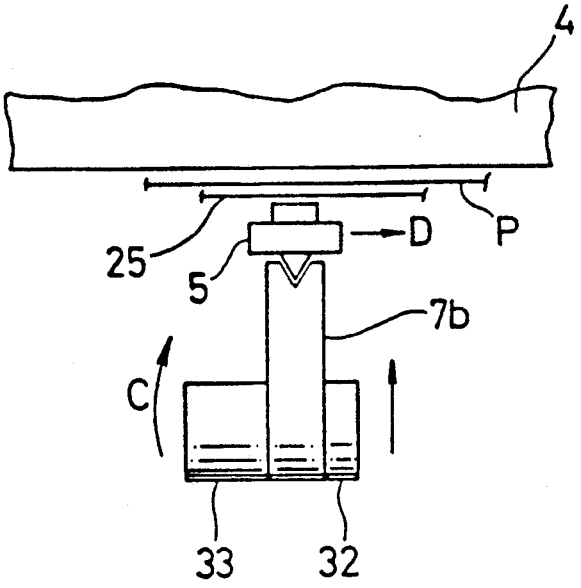

On a head 7*b* of the print hammer 7, as shown in FIG. 4, hammer weights 32 and 33 are mounted on the right side and the left side thereof respectively to make the hammering force at printing stronger and improve the transferability of ink of the print ribbon 25, and the hammer weight 33 of the left side is formed larger than the hammer weight 32 of the right side.

Accordingly, a printing mechanism PM is constituted with the platen 4 and a platen driving apparatus, the carriage 1 and a carriage driving apparatus, the type-wheel 6 and a type-wheel driving apparatus, the print ribbon 25 and a ribbon feed driving apparatus, a cam mechanism which swings the print ribbon 26 and the correction ribbon 29 to the three positions and a driving apparatus thereof, the print hammer 7 and a print hammer driving mechanism and the like, and as shown in FIG. 6, each driving apparatus of the printing mechanism PM is connected to a CPU 70 (Central Processing Unit) of a controlling apparatus C.

In the above-described typewriter, when a character key on a keyboard 40 is operated, the type-wheel drive motor 54 is rotated by a predetermined angle, and the type 5 corresponding to the character key is set in front of the print hammer 7, and the driving force of the DC motor 55 is transmitted to the cam mechanism through the clutching mechanism K2 by operation of the ribbon lift solenoid 53, and the holder 27 and the print ribbon 25 are driven swingingly to the print position. At this time, rotation of the engaging rotor 13 is restrained by engagement of the tip part 22*a* of the armature 22 with the engaging protrusion 15, and therefore the cam 9 cannot rotate also, and the clutch spring 14 is deformed elastically, storing an elastic distortion energy.

Figure 3:
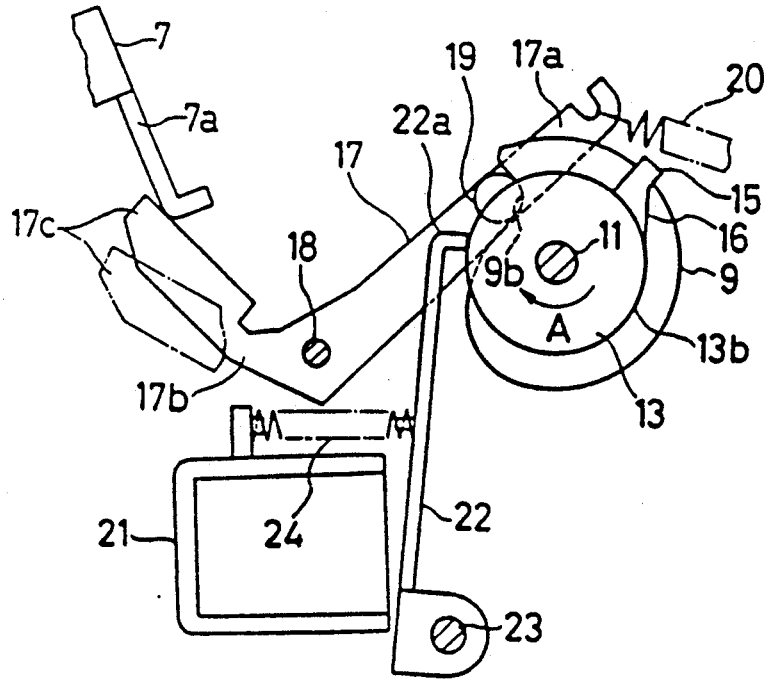

Subsequently, the print hammer solenoid 21 is energized for a minute time, and the armature 22 is attracted, and the tip part 22*a* thereof is released from the engaging protrusion 15, and then the engaging rotor 13 and the cam 9 are quickly rotated in the direction as shown by the arrow A by an elastic force of the clutch spring 14 in the engaging rotor 13, and as shown in FIG. 3, the cam follower 19 is engaged with the recession 9*b*, and the operating lever 17 is quickly rotated from the ready-to-operate position to the hammering position by an elastic force of the tension spring 20, and the cam follower 19 is engaged with the recession 9*b*, and the rotation of the operating lever 17 is stopped. Following this operating lever 17, the print hammer 7 is quickly rotated from the retreat position to the print position, and the type 5 is hammered by the print hammer 7, and thereby the type 5 is hammered onto the print paper P through the print ribbon 25.

Figure 5:
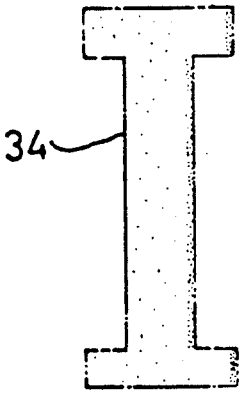

At this time, as shown in FIG. 5, assuming that, for example, a character 'I' is printed, the hammer weight 33 is larger than the hammer weight 32, and therefore a turning torque in the direction as shown by the arrow C is applied to the print hammer 7 along with the hammering force, and the type 5 sideslips by a minute distance in the direction as shown by the arrow D. As a result, ink 34 of the print ribbon 25 firmly adheres particularly to the right-side edge part of the character 'I', and this edge part becomes a portion difficult to be erased when erasing this character 'I'.

Here, when an erase key on the keyboard 40 is operated, the type 5 being the same as the printed character is set in front of the print hammer 7, the holder 27 is swung to the correcting position, the printing mechanism PM is operated likewise the case of character printing, and the printed character is lifted off the print paper P by the correction ribbon 29, being erased.

Next, description is made on the whole configuration of a control system of the typewriter with reference to a block diagram in FIG. 6.

The printing mechanism PM comprises a platen drive motor 50 and a driver 60 thereof, a carriage drive motor 51 and a driver 61 thereof, the ribbon feed motor 52 and a driver 62 thereof, the ribbon lift solenoid 53 and a driver 63 thereof, the type-wheel drive motor 54 and a driver 64 thereof, the print hammer solenoid 21 and a driver 65 thereof, the DC motor 55 and a driver 66 thereof and the like, and the respective drivers 60–66 are connected to the CPU 70.

The keyboard 40 is provided with character keys including alphabet keys, numeral keys and symbol keys and various function keys including a correction command key, likewise the normal typewriter.

The controlling apparatus C is constituted with the CPU (Central Processing Unit) 70 and a ROM (Read Only Memory) 80 and a RAM (Random Access Memory) 90 which are connected to the CPU 70 through a data bus or the like.

A program memory 81 of the ROM 80 stores a program controlling the printing mechanism PM in accordance with code data entered from each character key and each function key on the keyboard 40, a control program for controlling character erasure as described later and the like.

The RAM 90 is provided with a current position memory 91 which sequentially renews and stores the current position of the print head of the carriage 1 from the absolute origin so as to correspond to the print position in the typewriter mode, a printed data memory 92 which sequentially stores data of printed characters and the like by about 500 characters so as to correspond to the print position, a text memory 93 for storing inputted data in the memory mode, various memories storing temporarily the results of processing in the CPU 70 and the like.

In accordance with the control program, the CPU 70 controls the printing mechanism PM to print characters and symbols corresponding to data entered from each character key, and controls the printed data memory 92 sequentially to store the printed data so as to correspond to the print position. Furthermore, when the correction command key is operated, the CPU 70 outputs control signals to the respective drivers 60–66 based on the data of the current position memory 91 and the printed data memory 92, and thereby the type 5 being the same as the printed character is hammered through the correction ribbon 29, and thus the printed character is erased.

Figure 7:
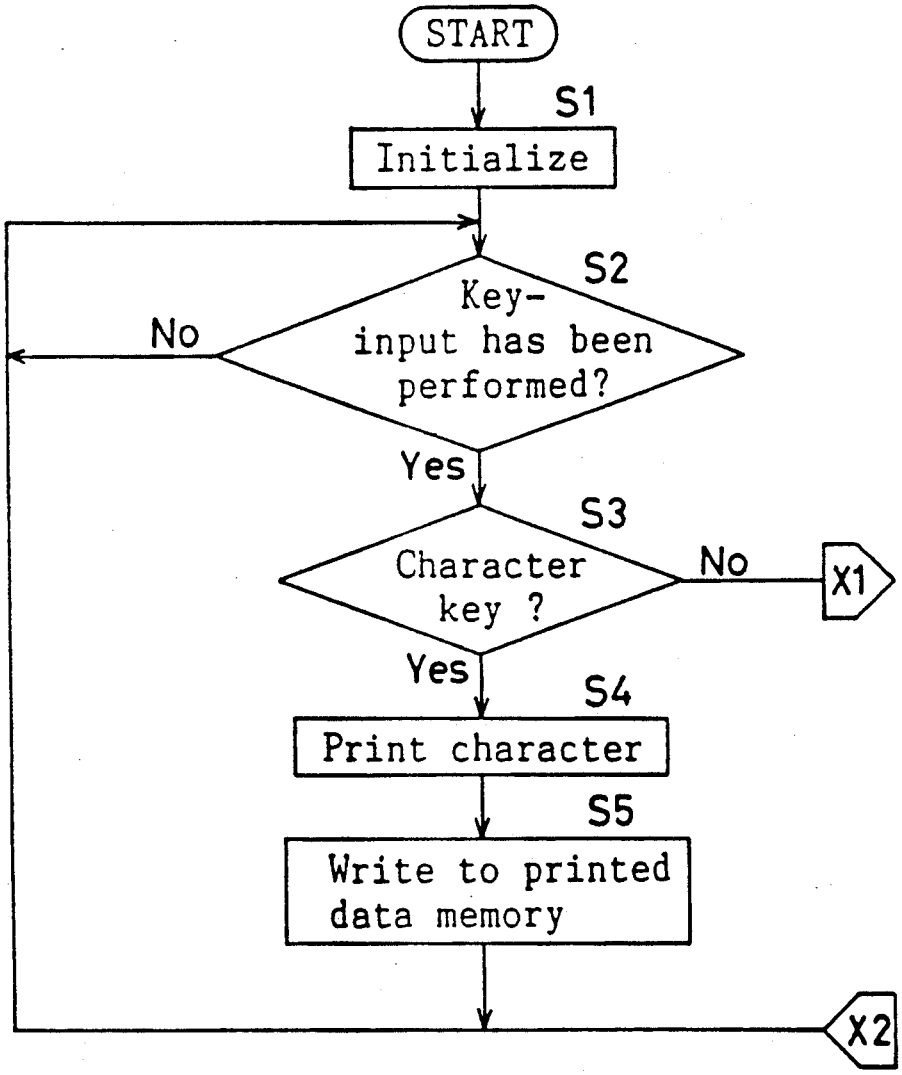
Figure 7:
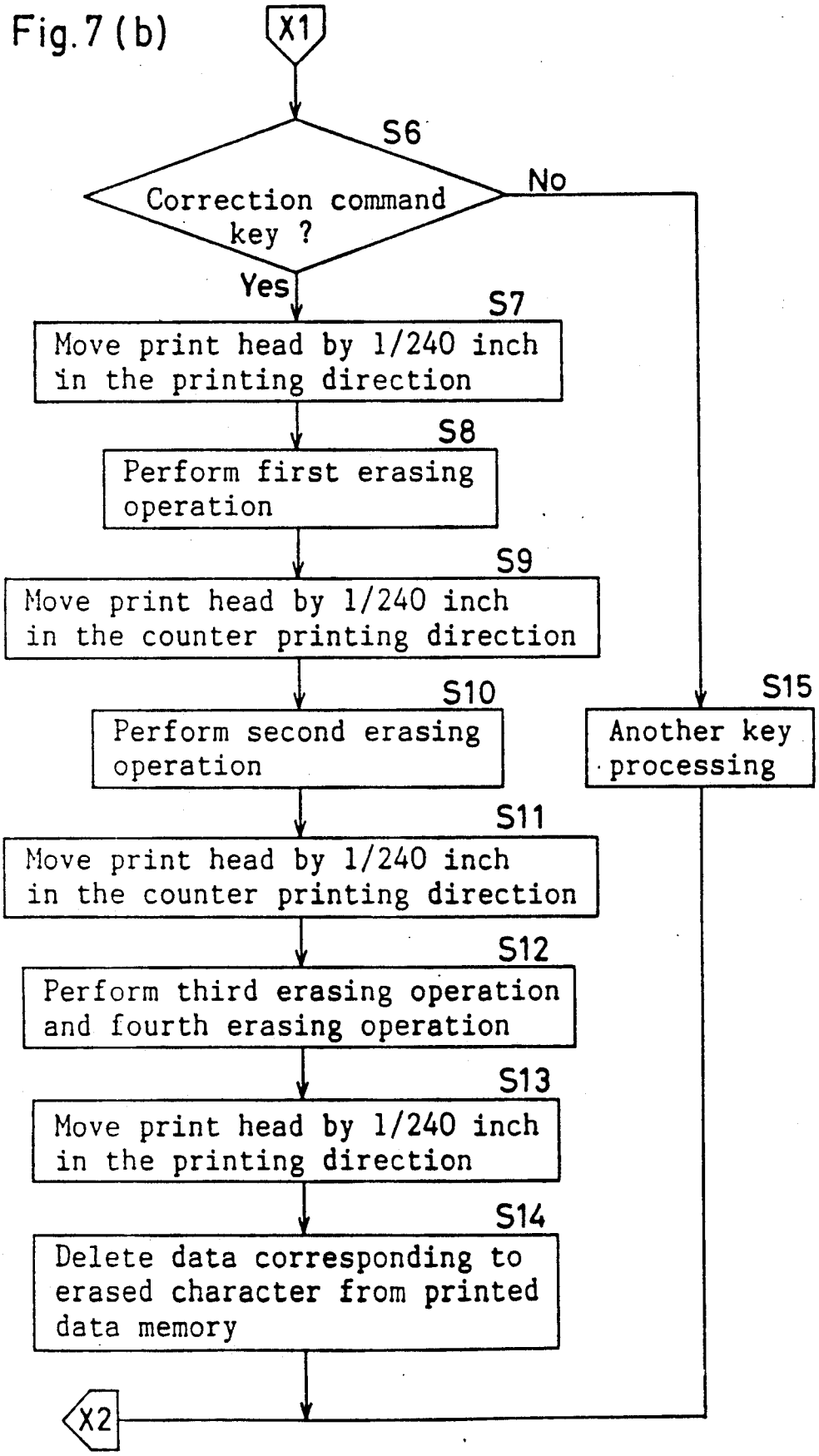
Figure 8A:
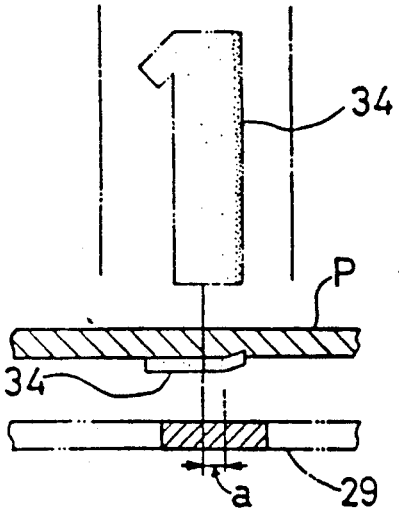
Figure 8D:
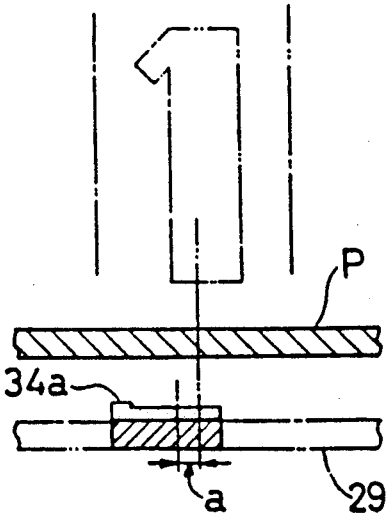
Figure 8B:
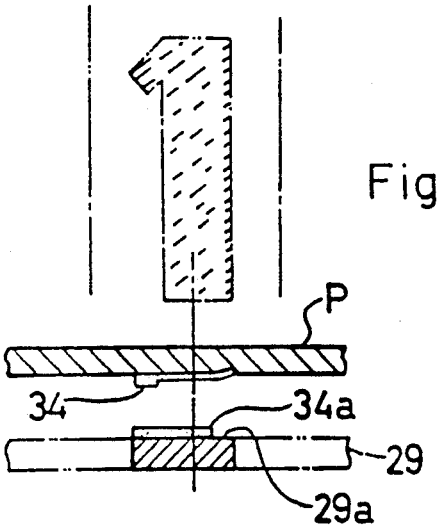
Figure 8C:
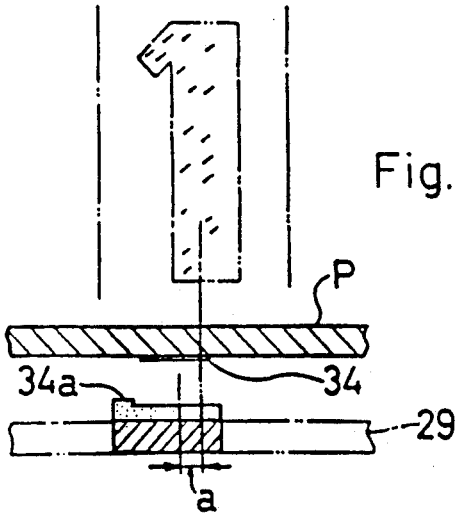
Figure 9A:
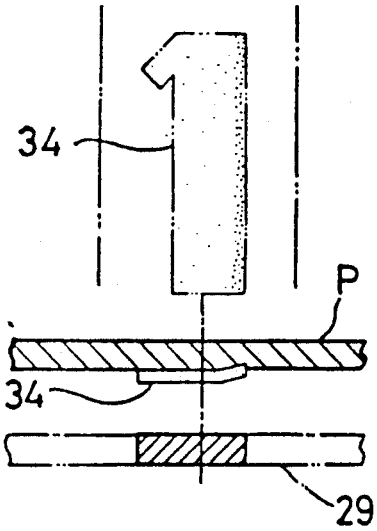
Fig.9(a) PRIOR ART
FIG. 9 is a view explaining the conventional character correction control.
Figure 9D:
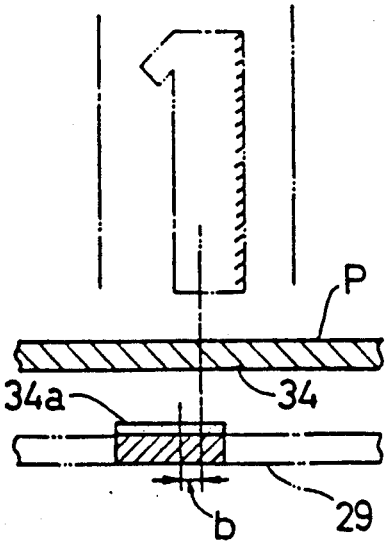
Fig.9(d) PRIOR ART
Figure 9B:
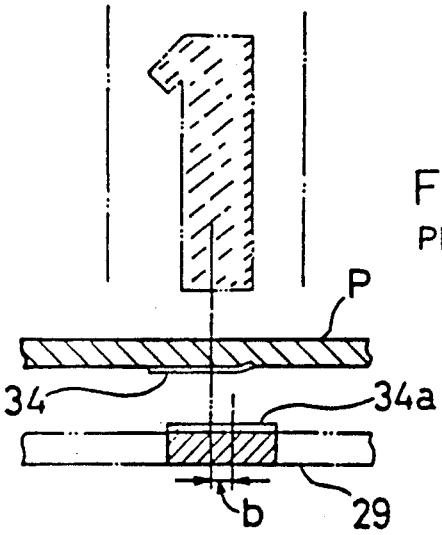
Fig.9(b) PRIOR ART
Figure 9C:
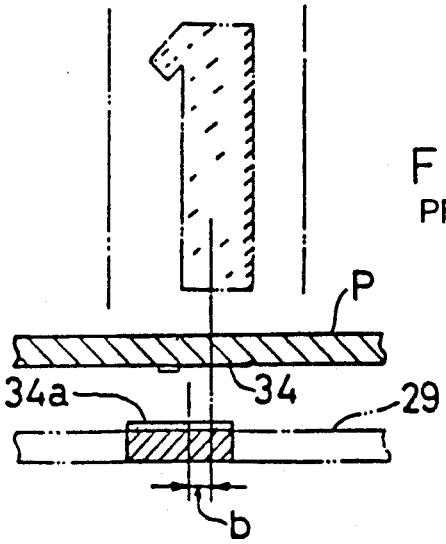
Fig.9(c) PRIOR ART

Next, description is made on character correction control performed in the controlling apparatus C of the typewriter with reference to a flow chart in FIG. 7. In addition, for descriptive convenience, description is made including character print control.

By turning on the power switch of the typewriter, this control is started, and processing proceeds to step S1 (hereafter, represented simply as S1, and the same is true of the other steps), and initialization is executed, and processing proceeds to S2, being ready for a key-input. In S2, when a key is depressed, processing proceeds to S3, and whether or not it is a character key is judged, and when it is a character key, processing proceeds to S4. In S4, a character corresponding to the inputted data is printed.

At this time, the CPU 70 outputs control signals to the respective drivers 60–66. For example, as shown in FIG. 8(*a*), a character '1' is printed, and the ink 34 of the print ribbon 25 adheres heavily to the right-side edge part of this character '1'.

In the next S5, the printed data is written to the printed data memory 92 so as to correspond to the print position, and processing returns to S2.

Here, when the operator has noticed a wrongly printed character and operates a carriage move key to move the print head to the wrongly printed position, processing proceeds to S15 through S2–S3 and S6, and the print head is moved in the direction commanded by a carriage move key, and processing returns to S2.

Subsequently, by operating the correction command key, processing proceeds to S6 through S2 and S3, and the result of the judgement becomes YES, and processing proceeds to S7. In S7, the carriage drive motor 51 is rotated forward by one step, and the print head is moved by 1/240 inch (illustrated with 'a' in FIG. 8) in the printing direction (direction of spacing). For example, as shown in FIG. 8(*a*), the center position of the width of the correction ribbon 29 equivalent to the width of the printed character '1' (i.e. erase position) is moved in the printing direction by a distance equal to 1/240 inch. In addition, the direction of this movement is the same as the printing direction, and therefore wire tension and backlash of the carriage drive system can be neglected.

In the next S8, in accordance with the data of the current position memory 91 and the data of the printed data memory 92, the type-wheel drive motor 54 is driven and the type 5 being the same as the character printed at the current print head position is set in front of the print hammer 7, and a first erasing operation is executed. At this time, the CPU 70 outputs control signals to the respective drivers 60–66 as required. For example, as shown in FIG. 8(*b*), out of the ink 34 of the printed character '1', the ink 34 of the portion whereon the type 5 is hammered through the correction ribbon 29 is almost stripped off, and the stripped ink 34*a* adheres to the correction ribbon 29. However, the ink 34 still remains on the right-side edge part of the printed character '1'.

In the next S9, the carriage drive motor 51 is rotated backward by one step, and the print head is moved by 1/240 inch in the counter printing direction (direction of backspacing) (FIG. 8(*b*)). In the next S10, a second erasing operation is executed. At this time, for example, as shown in FIG. 8(*b*), when the type 5 is hammered covering the whole width of the character through the correction ribbon 29, the second erasing operation is executed with the portion of the correction ribbon 29 not used in the preceding first erasing operation, that is, an unused fresh portion 29*a* whereto the ink 34*a* did not adhere facing the right-side edge part difficult to be erased of the printed character, and therefore the ink 34 of the portion difficult to be erased is certainly stripped off.

In S11, the carriage drive motor 51 is rotated backward by two steps, and thereafter it is rotated forward by one step, and then the print head is moved from the print position by 1/240 inch in the counter printing direction (FIG. 8(*c*)). In the next S12, a third erasing operation and a fourth erasing operation are executed. For example, as shown in FIG. 8(*c*), the type 5 is hammered twice through the correction ribbon 29 to prevent the ink 34 from remaining on the left-side portion of the width of the character, an therefore, as shown in FIG. 8(*d*), all of the ink 34 of the printed character '1' is stripped off, and the character '1' is certainly erased.

In the next S13, the carriage drive motor 51 is rotated forward by one step, and the print head is moved by 1/240 inch in the printing direction, returning to the original print position. Since corrections for wire tension and backlash of the carriage drive system are made in the above-mentioned S11, no error is produced as to the print head position. In S14, the data of the printed character which has been erased is deleted from the printed data memory 92, and processing returns to S2.

As described above, in the case of erasing a printed character which has the right-side edge part where the ink 34 adheres heavily when printing the character, the print head is moved toward the edge part, and then the first erasing operation is performed, and subsequently the print head is made to agree with the print position, and then the second erasing operation is performed, therefore the right-side edge part is erased twice by the unused fresh portion of the correction ribbon 29 whereon the ink 34 does not adhere, and thus the ink of the right-side edge part is certainly erased.

In addition, in the above-mentioned embodiment, description is made on the character erasure control for a printed character which has the right-side edge where the ink 34 adheres heavily when printing the character, but in the case where the ink 34 adheres firmly to the left-side edge part at character printing, needless to say, the direction of movement of the print head has only to be reversed in the above-mentioned character erasure control.

In the above-mentioned embodiment, description is made on the case of erasing the normal printed character, but the present invention can also be applied to erasure of a bold character in a manner that the print head is moved from the print position where superposed print has been made lastly in the printing direction by 1/240 inch and the first erasing operation is performed, and thereafter the erasing operation is performed every time the print head is moved in the counter printing direction by 1/240 inch (three times), and after correcting backlash, the erasing operation is performed twice at the position after movement of 1/240 inch in the counter printing direction.

In addition, in the above-mentioned embodiment, description is made on the case where the present invention is applied to the typewriter comprising the printing mechanism printing characters by mechanical drive, but it is needless to say that the present invention is applicable also to various typewriters comprising such a printing mechanism wherein the ink 34 adheres heavily to the right-side or left-side edge part of a character in printing the character.

What is claimed is:

1. A character erasable printing apparatus comprising:

inputting means for inputting data of characters and symbols and various command data, printing means which comprises a type-wheel having a plurality of type elements of characters and symbols, a print ribbon fed from a supply spool of a ribbon cassette and a hammering mechanism provided with an asymmetrical hammering weight with respect to a hammering center coincident with a center of a type element to be hammered and which prints characters and symbols corresponding to inputted data, a carriage which mounts said printing means and is driven in a first direction and in a second direction opposite to said first direction along a printing line by a carriage drive motor, erasing means which comprises said type-wheel, a correction ribbon and said hammering mechanism which are mounted on said carriage, and which erases a printed character or symbol by hammering the same type element plural times onto said printed character or symbol through said correction ribbon in response to an operation of a correction command key installed on said inputting means, and said correction ribbon being installed to move relative to said printed character or symbol together with said carriage corresponding to movement of said carriage, and correction controlling means which, in erasing operation of said erasing means, controls said carriage to move to a first erasing position displaced by a predetermined minute distance from the printed position of said printed character or symbol in the first direction along said print line toward an over-inked edge portion of said printed character or symbol which is formed on an opposite side to a larger weight portion of said asymmetrical hammering weight with respect to said hammering center and then controls said erasing means to conduct a first erasing of said over-inked edge portion, and subsequently controls said carriage to move to a second erasing position in the second direction opposite to said first direction without feeding said correction ribbon relative to said carriage until a fresh portion of said correction ribbon facing said type element faces said over-inked edge portion and then controls said erasing means to conduct at least a second erasing of the over-inked edge portion.

2. A character erasable printing apparatus in accordance with claim 1, wherein said correction controlling means further comprises error correcting means which, in moving said carriage in the second direction, initially controls said carriage to move in the second direction by an amount movement larger than a required amount of movement, and subsequently controls said carriage to move in the first direction by an amount of excess movement.

3. A character erasable printing apparatus in accordance with claim 1, wherein said hammering mechanism is a mechanical one comprising a cam mechanism having an engaging rotor, a clutch spring and a cam and being driven by a motor, an operating lever driven swingingly by said cam mechanism and a hammer driven swingingly by said operating lever and provided with weights.

4. A character erasable printing apparatus in accordance with claim 1, wherein said correction ribbon of said erasing means is held stationary with respect to said hammering mechanism during the total erasing operation of said erasing means.

5. A character erasable printing apparatus in accordance with claim 4, wherein the second erasing position of said carriage substantially equals the print position of the printed character or symbol being erased.

6. A character erasable printing apparatus in accordance with claim 5, wherein said correction controlling means controls said carriage subsequent to the second erasing to move to a third erasing position displaced in the second direction by said predetermined minute distance from the print position of the printed character or symbol being erased and then controls said erasing means to conduct a third erasing.

7. A character erasable printing apparatus in accordance with claim 6, wherein said correction controlling means controls said erasing means to conduct a fourth erasing when said carriage is in the third erasing position.

8. A character erasable printing apparatus comprising:

inputting means for inputting data of characters and symbols and various command data, printing means which comprises a type-wheel having a plurality of type elements of characters and symbols, a print ribbon red from a supply spool of a ribbon cassette and a hammering mechanism provided with an asymmetrical hammering weight with respect to a hammering center coincident with a center of said type element to be hammered, and which prints characters and symbols corresponding to inputted data, while forming an over-inked edge portion on an opposite side portion of said printed character or symbol to a larger weight portion of said asymmetrical hammering weight with respect to said hammering center, a carriage which mounts said printing means and is driven in a first direction and a second direction opposite to said first direction along a printing line by a carriage drive motor, erasing means which comprises said type-wheel, a correction ribbon and said hammering mechanism which are mounted on said carriage, and which erases a printed character or symbol by hammering the same type element plural times onto said printed character or symbol through said correction ribbon in response to an operation of a correction command key installed on said inputting means, and said correction ribbon being installed to move relative to said printed character or symbol together with said carriage corresponding to movement of said carriage, and correction controlling means which, in erasing operation of said erasing means, controls said carriage to move to a first erasing position displaced by a predetermined minute distance from the print position of said printed character or symbol in the first direction along said print line toward an over-inked edge portion and then controls said erasing means to conduct a first erasing of said over-inked edge portion, and subsequently controls said carriage to move to a second erasing position in the second direction opposite to said first direction without feeding said correction ribbon relative to said carriage until a fresh portion of said correction ribbon facing said type element faces said over-inked edge portion and then controls said erasing means to conduct at least a second erasing of the over-inked edge portion.

* * * * *